US005551567A

United States Patent [19]

Malone et al.

[11] Patent Number: 5,551,567

[45] Date of Patent: Sep. 3, 1996

[54] BLISTER PACKAGE CONTAINING GRIPPING MEANS

[75] Inventors: Yolanda Malone, Wyncote, Pa.; James Warner, New York, N.Y.; Richard Park, Pallisades Park, N.J.

[73] Assignee: McNeil-PPC, Inc., Milltown, N.J.

[21] Appl. No.: 235,072

[22] Filed: Apr. 29, 1994

[51] Int. Cl.[6] ..... B65D 85/48

[52] U.S. Cl. ..... 206/469; 206/532; 383/200; 383/205

[58] Field of Search ..... 206/532, 539, 206/461, 469; 383/200, 205, 209

[56] References Cited

U.S. PATENT DOCUMENTS

| | | | |
|---|---|---|---|
| 2,865,212 | 9/1958 | Parmer | 383/200 |
| 3,809,220 | 5/1974 | Arcudi | 383/200 |
| 3,941,248 | 3/1976 | Moser et al. | 206/532 |
| 4,159,771 | 7/1979 | Komatsu et al. | 206/532 |
| 5,088,603 | 2/1992 | Kirkpatrick | 206/532 |
| 5,275,284 | 1/1994 | Onotsky | 206/469 |
| 5,310,060 | 5/1994 | Bitner et al. | 206/532 |
| 5,325,968 | 7/1994 | Sowden | 206/532 |

*Primary Examiner*—David T. Fidei
*Attorney, Agent, or Firm*—Paul A. Coletti

[57] ABSTRACT

A blister package is described which contains at least one blister having a well which is adapted to hold a medicinal dosage. A cover is placed over the well to seal the well on the blister. A score line is placed on the blister on the cover to allow the user to open the blister and cover to obtain the dosage from the well. There are placed on the blister a pair of gripping surfaces on either side of the score line which enable the user to grip the blister and more readily open the blister package.

20 Claims, 3 Drawing Sheets

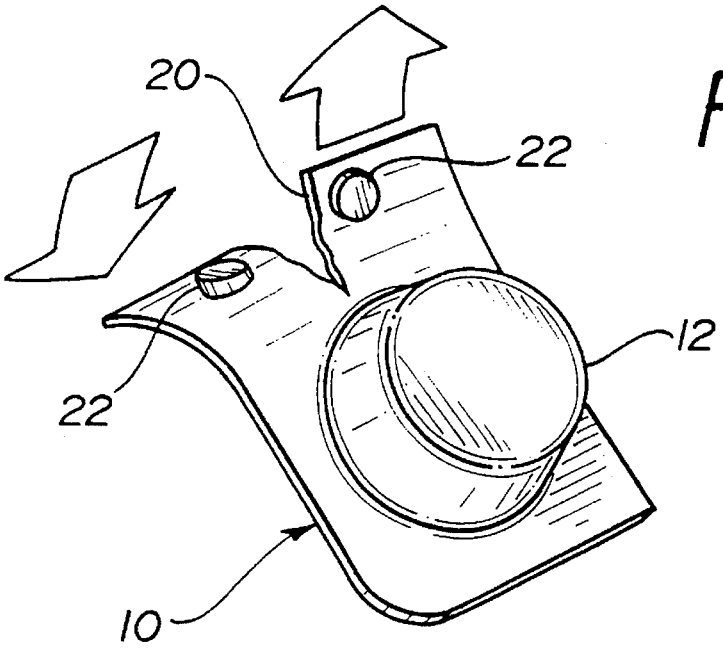
FIG. 3
FIG. 4
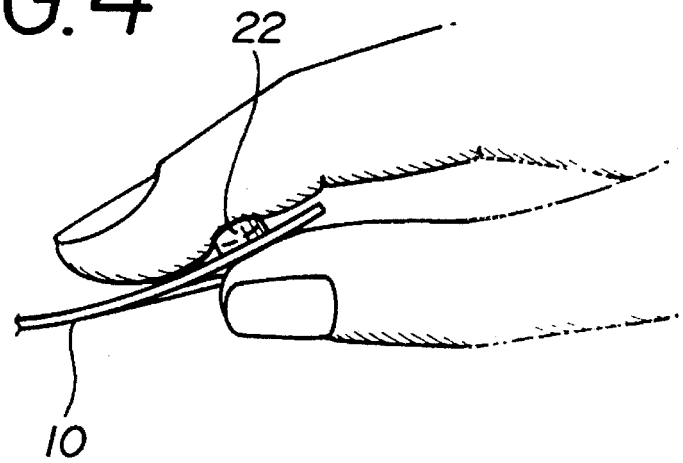

BLISTER PACKAGE CONTAINING GRIPPING MEANS

FIELD OF THE INVENTION

Generally, this invention relates to blister packages capable of holding medicinal dosages. More specifically, this invention relates to blister packages capable of holding tablets for providing medicinal dosages to patients.

BACKGROUND OF THE INVENTION

Blister packages containing a well adapted to hold a medicinal dosage, typically a tablet, have existed for quite some time. Typically these blisters packages contain a cover, generally a portion of mylar or some other metallic material, which is adhesively attached in a sealing arrangement with the blister well. Thus, the well is sealed from the environment and the tablet held within the well is capable of being maintained in a stable condition for quite a long time.

Typically, also, each of these blister packages contains a score line made in both the blister and the cover which allows the user to position blister for opening. In fact, without such a score line it can be quite difficult to open the blister package. These packages are made from strengthened materials such as hardened plastics, and with the cover, can form quite a difficult mechanism to overcome with the human hand. Also, it should be remembered, that the surfaces of these tablet blister packages are quite small, typically no larger than 30mm in length, with the well itself roughly 15 mm in length. Thus, there is only the remaining 15 mm with which two fingers can grip the surface of the package.

Thereafter, easy access of the blister packages is indeed quite a concern of the designers of these packages.

SUMMARY OF THE INVENTION

The need for an easy to grip blister package is overcome by the present invention. The package described herein contains at least one blister with a well adapted to hold a unit medicinal dosage, typically a tablet. There is a cover placed in sealing arrangement over the blister in order to seal the well from the environment. On the blister surface, and aligned with the surface of the cover, there is placed a score line which forms a weakened portion on the cover and the blister, such that it enables the user to tear the blister to expose the well.

Also on the blister there is a raised surface which is adapted for gripping the blister package. Typically, there are two such raised surfaces one on either side of the score line of the blister package. These surfaces may either be circular, rectangular, oval or other similar easy to manipulate shapes and can be appropriately placed about the score line in order to form an accurate and easy to obtain gripping surface to open the blister package.

When used, the gripping surfaces allow the user to pull the blister package on either side of the score line so as to readily open the blister package and obtain the dosage tablet without great difficulty.

DESCRIPTION OF THE DRAWINGS

The invention described herein will be better understood from the attached drawings, which include:

FIGS. 3 and 4 are sequential steps of opening the blister package of the present invention, each in perspective;

DETAILED DESCRIPTION OF THE INVENTION

Figure 1:
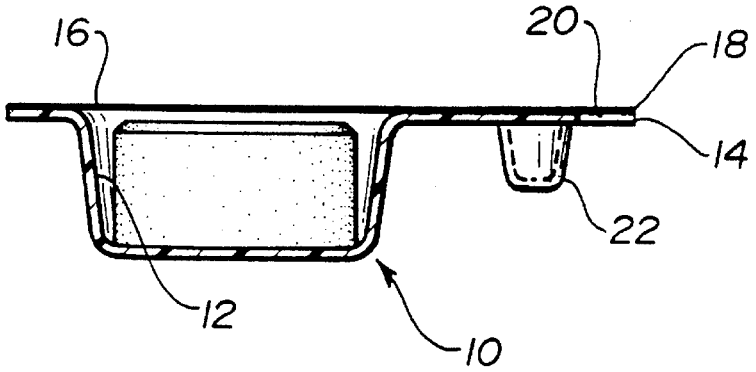
FIG. 1 which is a cross-sectional view of a blister package of the present invention.
Figure 2:
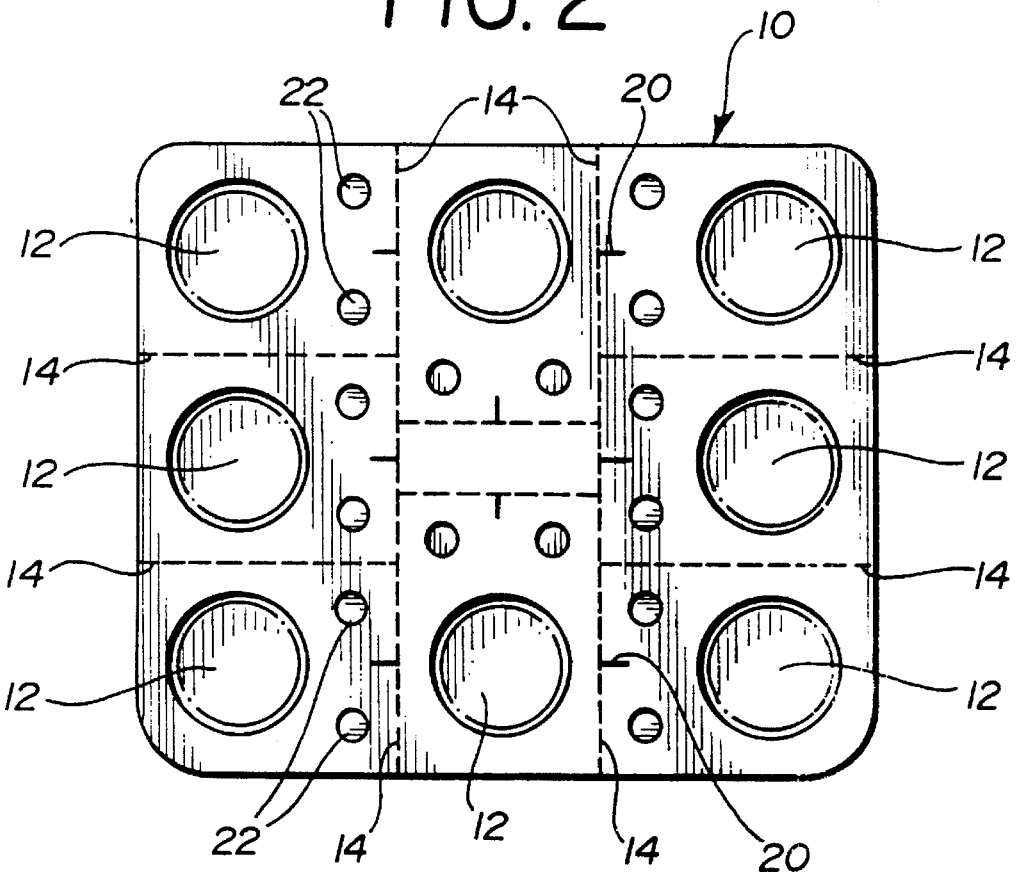
FIG. 2 is a top plan view of a typical embodiment of a blister package of the present invention.

The invention described herein can be seen in FIGS. 1 through 4. There is contained a blister package 10 which contains a plurality of medicinal dosage wells 12. Each of these wells 12 are separable from the remainder of the package 10 via score lines 14 which surround each of the wells. As seen in FIG. 2, in this package 10 there are typically seven wells contained on the blister, although of course, various other alternate embodiments are easily imaginable and useful. For instance eight such wells, in a four by two configuration, is certainly feasible and may be desirable. Other configurations of six or even twelve wells are certainly possible. Each of the wells 12 are capable of holding a dosage of a medicament, typically a unit dosage tablet which is cylindrical in shape and fits within the well 12 and is ready to be swallowed by the user. Each of the wells 12 is sealed by a cover 16 which also typically has score lines 18 colinear with score line 14 on wells 12. Thus, each individually unit dosage is readily separable from the remainder of the package 10 in a sealed arrangement so that it may be used immediately, while the remainder of the package 10 maintains its seal.

As can also be seen from the figures, each of the blister arrangements has a score line 20, typically a shortened portion on one side of the well 12 which allows the user to open the well 12. Typically, the user grips the score line 20 with two fingers of either hand on either side of the line 20. Then, the user tears the package so as to separate the blister toward the well 12. Once the blister is separated at the well 12, the cover 16 can be torn from the surface of the well 12 and the unit dosage tablet is readily obtained by the user. Of course, each of the blisters 10 contains a score line 20 so that each blister is operable individually by the user, so that the package of the present arrangement is able to be used over a series of dosage periods, without losing stability of any of the tablets contained in the package.

Figure 5:
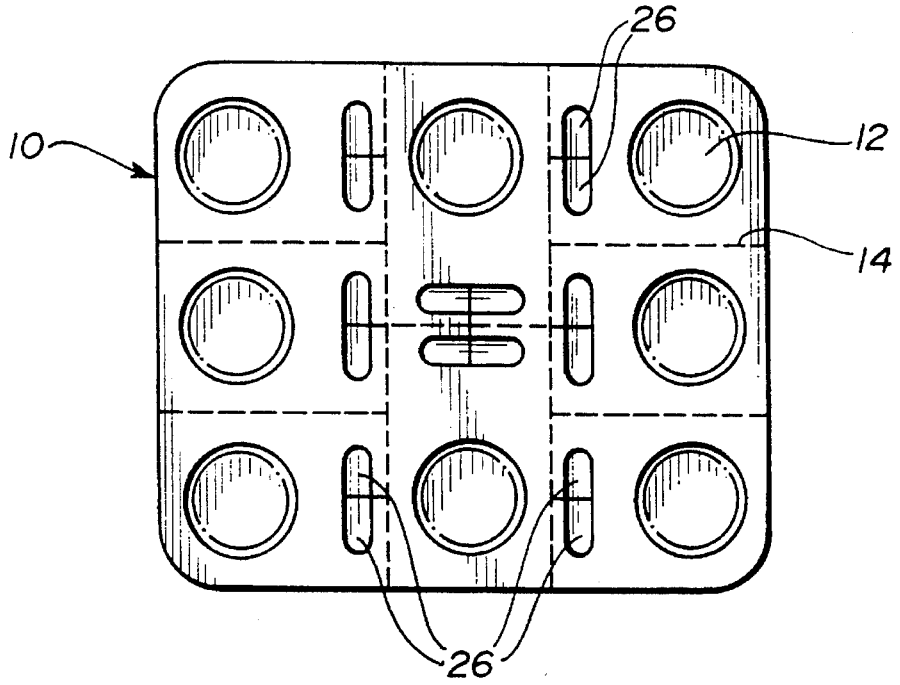
FIG. 5 is an alternate embodiment of the present invention showing a different gripping surface.
Figure 6:
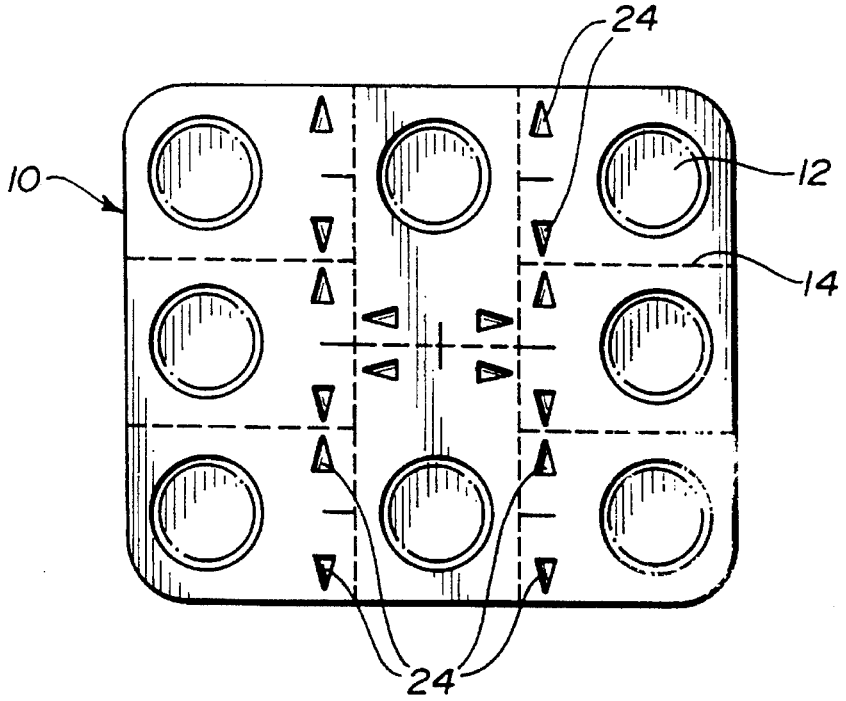
FIG. 6 is yet another alternate embodiment of the present invention showing yet another gripping surface for use with the present invention.

As can further be seen, the present package contains a gripping surface 22 contained on either side of the score line 20 contained on a blister 10. Typically, the gripping surface 22 is placed centrally about the portion created on either side of the score line 20. The gripping surface 22 does not need to be as deep as the package or the well 12 which contains a tablet, but rather needs to allow the user's fingers to obtain a "feel" for either side of the score line 20 in order to appropriately pull apart the package 10. It is envisioned that the depth of the well be roughly 5 to 10 mm in depth, although certainly other depths are certainly possible, and indeed even may be useful. Also, it is envisioned that not only circular gripping surfaces 22 as seen in FIG. 1 through 4 are possible but certainly other gripping surfaces such as ovals 26 (FIG. 5), triangles 24 (FIG. 6) tines or rectangles may be useful. Certainly other types of gripping surfaces can be envisioned, and may even provide greater or better usage to the patient than the ones described in the present specification.

In use therefore, the user separates one blister 10 from the package. Typically this is done by tearing apart the blister 10 along the series of score lines 14 which surround the entire blister. Then, the user places the thumb and forefinger of each hand on either side of the shorter score line 20 which will now open the blister 10 at the well 12 to obtain a unit dosage. The user grips (typically with the thumb), the surface of the blister 10 which contains the gripping surface 22. At this point, the user pulls apart the blister package, by applying friction to the gripping surface 22 on the portion of the gripping surface contained between the gripping surface 22 and the well 12. With the forefinger, the user then applies an opposite force so that the one portion of the blister 10 is pulled in one direction and the other portion of the blister 10 is pulled in the opposite direction. Typically, this shears the blister package 10, in order to obtain access to the well 12 and the unit dosage contained in the blister. Thereafter, the user is capable of opening the package by removing the cover 16 and taking the unit dosage contained in the blister package.

Although various embodiments have been described in this specification, it will be appreciated to those of ordinary skill in the art, that other alternate embodiments are able to be derived without undue experimentation. Therefore, it is to be appreciated that the invention described herein is to be understood by the attached claims and their equivalents.

What is claimed is:

1. A package comprising:

at least one blister having a well adapted to hold a medicament dosage, a cover placed in sealing arrangement with said blister;

a score line in said blister and said cover, said score line forming a weakened portion on said cover and blister to enable tearing of said blister to expose said well; and a raised surface on said blister adapted for gripping said blister, said raised surface spaced apart from said score line.

2. The package of claim 1 wherein there are a plurality of blisters.

3. The package of claim 1 wherein there are a pair of said raised surfaces, one said surface on either side of said score line.

4. The package of claim 1 wherein said raised surface is circular in shape.

5. The package of claim 1 wherein said raised surface is oval in shape.

6. The package of claim 1 wherein said raised surface is rectangular in shape.

7. In a package having a blister and a cover attached to said blister, the improvement comprising a score line on said blister and said cover and at least two gripping surfaces, one said gripping surface on either side of said score line, each of said gripping surfaces spaced apart from said score line.

8. The package of claim 7 further comprising at least one raised surface placed on a said gripping surface.

9. The package of claim 7 wherein there are a plurality of blisters.

10. The package of claim 8 wherein said raised surface is circular in shape.

11. The package of claim 8 wherein said raised surface is oval in shape.

12. The package of claim 8 wherein said raised surface is rectangular in shape.

13. A package comprising:

at least one blister having a well adapted to hold a medicament dosage, a cover placed in sealing arrangement with said blister;

a score line in said blister and said cover, said score line forming a weakened portion on said cover and blister to enable tearing of said blister to expose said well;

a raised surface on said blister adapted for gripping said blister said raised surface spaced apart from said score line; and said blister forming a portion of said package.

14. The package of claim 13 wherein there are a plurality of blisters arranged on said package to constitute the entire package.

15. The package of claim 13 wherein there are a plurality of blisters.

16. The package of claim 15 wherein there are seven said blisters.

17. The package of claim 15 wherein there are a pair of said raised surfaces, one said surface on either side of said score line.

18. The package of claim 15 wherein said raised surface is circular in shape.

19. The package of claim 15 wherein said raised surface is oval in shape.

20. The package of claim 15 wherein said raised surface is rectangular in shape.

* * * * *